US005686184A

United States Patent [19]

Akamatu et al.

[11] Patent Number: 5,686,184

[45] Date of Patent: Nov. 11, 1997

[54] THERMAL TRANSFER SHEET

[75] Inventors: Yoshimoto Akamatu; Shigeki Kusuba; Toshiyuki Yamane; Masumi Miyagi, all of Osaka; Takehira Kaneko, Odawara; Masashi Kamiyama, Kanagawa-ken, all of Japan

[73] Assignee: Fujicopian Co., Ltd., Japan

[21] Appl. No.: 615,400

[22] Filed: Mar. 14, 1996

[30] Foreign Application Priority Data

Mar. 15, 1995 [JP] Japan ..... 7-055545

[51] Int. Cl.[6] ..... B41M 5/26; B41M 5/035; B41M 5/38

[52] U.S. Cl. ..... 428/411.1; 428/195; 428/321.3; 428/484; 428/488.4; 428/913; 428/914; 503/227

[58] Field of Search ..... 428/488.4, 484, 428/411.1, 423.1, 195, 321.3, 913, 914; 503/226, 227

[56] References Cited

FOREIGN PATENT DOCUMENTS 63-102982 5/1988 Japan ..... 428/488.4

*Primary Examiner*—Pamela R. Schwartz
*Attorney, Agent, or Firm*—Fish & Neave

[57] ABSTRACT

A thermal transfer sheet is provided which comprises: a foundation; a recording agent layer provided on one side of the foundation; and a back layer provided on the other side of the foundation and containing a binder resin and a charge-transfer complex; wherein the charge-transfer complex comprises an electrically conductive organic polymer serving as an electron donor and an electron acceptor; and wherein the back layer has a surface resistivity of not greater than $10^{11}\Omega/cm^2$.

6 Claims, 1 Drawing Sheet

THERMAL TRANSFER SHEET

BACKGROUND OF THE INVENTION

The present invention relates to a thermal transfer sheet having a recording agent layer formed on one side of a foundation thereof and a back layer formed on the other side of the foundation. More particularly, the invention relates to a thermal transfer sheet having a back layer subjected to an antistatic treatment.

One conventional method for thermal transfer recording is to heat a thermal transfer sheet having a heat-meltable ink layer formed on one side of a foundation, such as of a polyester film, from the back side of the foundation by means of a thermal head and selectively transfer a portion of the heat-meltable ink onto a receptor to form a print image on the receptor.

The thermal transfer sheet is formed with a back layer. (stick preventive layer) composed of a heat-resistant resin and a lubricating agent optionally blended therewith on the back side of the foundation (which is brought into slide contact with the thermal head) to prevent the foundation from fusing and sticking onto the thermal head.

However, the conventional back layer has a high surface resistivity (greater than $10^{19}\Omega/cm^2$) and, therefore, the thermal transfer sheet is electrostatically charged by friction occurring when the thermal transfer sheet is rubbed against the thermal head. Further, when the thermal transfer sheet is separated from a receptor, the thermal transfer sheet is also electrostatically charged. Where the static electricity of the charged thermal transfer sheet is large, the static electricity is discharged from the thermal transfer sheet to the thermal head, thereby damaging the thermal head.

A method for preventing the electrostatic charge of the thermal transfer sheet has been proposed in which an antistatic agent such as a phosphoric ester is applied on the surface of the back layer of the thermal transfer sheet or is added to the back layer.

Where the antistatic agent is applied on the surface of the back layer, a large mount of the antistatic agent is required in order to provide a satisfactory antistatic effect and, therefore, the surface of the back layer becomes excessively tacky. This results in a feed failure or blocking of the thermal transfer sheet and in a less sustainable antistatic effect. Where the antistatic agent is added to the back layer, the antistatic agent is required to bleed onto the surface of the back layer. To allow a sufficient mount of the antistatic agent to bleed, the back layer should contain the antistatic agent in a large amount. However, an excessively large amount of the antistatic agent contained in the back layer reduces the heat resistance of the back layer.

One exemplary method for effectively preventing the electrostatic charge is to add carbon black to the back layer. According to this method, the surface resistivity of the back layer can be reduced to not higher than $10^{11}\Omega/cm^2$. However, carbon black has a higher hardness than the other components of the back layer. If thermal transfer printing is continuously performed using a thermal transfer sheet formed with a back layer containing carbon black, the thermal head is liable to be worn and damaged. Particularly where the back layer of the thermal transfer sheet contains a large amount of carbon black to enhance the antistatic effect, the thermal head may be disastrously worn and damaged.

Japanese Unexamined Patent Publication No. 2-34393 (1990) proposes a thermal transfer sheet formed with a back layer including polyisocyanate as a principal component thereof and a small amount (not greater than 10% by weight) of electrically conductive carbon black with an oil absorptivity of not less than 400 ml/100 g.

However, that thermal transfer sheet cannot satisfactorily prevent wear and damage of the thermal head because the back layer contains carbon black.

Another method for preventing the electrostatic charge of the thermal transfer sheet is to provide the thermal transfer sheet with an antistatic layer or a thin metal layer in addition to the back layer (stick-preventive layer). However, this method requires a higher production cost.

In view of the foregoing, it is an object of the present invention to provide a thermal transfer sheet which effectively prevents the electrostatic charge while minimizing the damage to the thermal head.

The foregoing and other objects of the present invention will be apparent from the following detailed description.

SUMMARY OF THE INVENTION

In accordance with a first feature of the present invention, there is provided a thermal transfer sheet comprising: a foundation; a recording agent layer provided on one side of the foundation; and a back layer provided on the other side of the foundation and containing a binder resin and a charge-transfer complex; wherein the charge-transfer complex comprises an electrically conductive organic polymer serving as an electron donor and an electron acceptor; and wherein the back layer has a surface resistivity of not greater than $10^{11}\Omega/cm^2$.

In accordance with a second feature of the present invention, the thermal transfer sheet with the first feature is characterized in that the back layer contains a curing agent.

In accordance with a third feature of the present invention, the thermal transfer sheet with the second feature is characterized in that the curing agent is polyisocyanate.

In accordance with a fourth feature of the present invention, the thermal transfer sheet with the first through third features is characterized in that the electrically conductive organic polymer is a polypyrrole polymer.

In accordance with a fifth feature of the present invention, the thermal transfer sheet with the fourth feature is characterized in that the polypyrrole polymer is a polypyrrole polymer represented by formula (I):

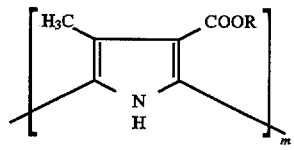

(I)

wherein m represents an integer of 100 to 10,000, and R is ethyl or butyl.

In accordance with a sixth feature of the present invention, the thermal transfer sheet with the first through fifth features is characterized in that the electron acceptor is 2,3,6,7-tetracyano-1,4,5,8-tetraazanaphthalene.

In accordance with a seventh feature of the present invention, the thermal transfer sheet with the first through sixth features is characterized in that the electrically conductive organic polymer and the electron acceptor are contained in the back layer in a total amount of 35% to 75% by weight.

In the thermal transfer sheet with the first feature, the back layer contains a binder resin and a charge-transfer complex comprising an electrically conductive organic polymer serving as an electron donor and an electron acceptor, and has a surface resistivity of not greater than $10^{11}\Omega/cm^2$. Therefore, the thermal transfer sheet is not electrostatically charged when the thermal transfer sheet is rubbed against a thermal head or separated from a receptor. The thermal head will not suffer from the electrostatic discharge from the thermal transfer sheet nor from damage by the electrostatic discharge. Since the back layer does not contain any hard component, damage to the thermal head can be minimized in comparison with the conventional thermal transfer sheet having a back layer containing carbon black.

In the thermal transfer sheet with the second feature, the back layer contains a curing agent and, therefore, the heat resistance of the back layer can be improved. Even if the thermal transfer sheet is stored in a rolled state at a high temperature, migration of components of the back layer can be reduced (the amount of components migrating from the back layer can be reduced). The migration herein means that the components contained in the back layer migrate from the back layer to a portion of the thermal transfer sheet brought in contact with the back layer when the thermal transfer sheet is rolled.

In the thermal transfer sheet with the third feature, the back layer contains polyisocyanate as the curing agent. Therefore, the heat resistance can be further improved, and the migration of the components of the back layer can be further reduced.

In the thermal transfer sheet with the fourth feature, the back layer contains a polypyrrole polymer as the electrically conductive organic polymer. Therefore, the surface resistivity of the back layer can be properly reduced.

In the thermal transfer sheet with the fifth feature, the back layer contains a polypyrrole polymer represented by formula (I) as the electrically conductive organic polymer. Therefore, the surface resistivity of the back layer can be further reduced.

In the thermal transfer sheet with the sixth feature, the back layer contains 2,3,6,7-tetracyanol, 1,4,5,8-tetraazanaphthalene as the electron acceptor. Therefore, the surface resistivity of the back layer can be further reduced.

In the thermal transfer sheet with the seventh feature, the back layer contains the electrically conductive organic polymer and the electron acceptor in a total amount of 35% to 75% by weight. Since the back layer has a sufficiently reduced surface resistivity and a sufficient heat resistance, the thermal head will not suffer from adhesion of dust from the back layer, and the back layer is free from sticking.

DETAILED DESCRIPTION

Figure 1:
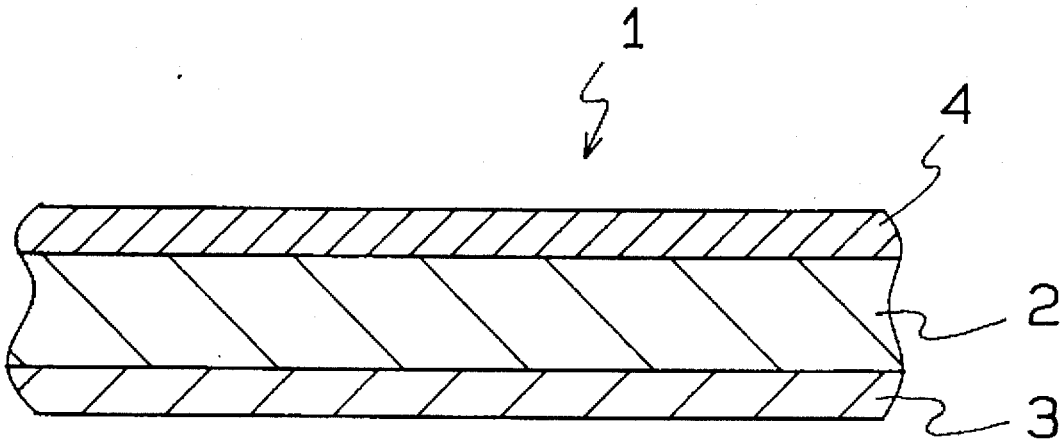
FIG. 1 is a schematic partial sectional view illustrating a thermal transfer sheet in accordance with an embodiment of the present invention.

The present invention will hereinafter be described in detail with reference to the attached drawing.

As shown in FIG. 1, a thermal transfer sheet 1 of the present invention comprises: a foundation 2; a recording agent layer 4 formed on one side of the foundation; and a back layer 3 formed on the other side of the foundation. The back layer 3 contains a binder resin and a charge-transfer complex. The charge-transfer complex comprises an electrically conductive organic polymer serving as an electron donor and an electron acceptor. The back layer has a surface resistivity of not greater than $10^{11}\Omega/cm^2$ and has excellent stick-preventing, heat-resisting and lubricating characteristics.

Examples of specific electrically conductive organic polymers to be used in the present invention include polypyrrole polymers, polyacetylene, polypara-phenylene, polymeta-phenylene and polythiophene. Among these, the polypyrrole polymers are particularly preferable because of their remarkable antistatic effect and stable solvent resistance.

Exemplary polypyrrole polymers include those represented by formulae (I) and (II):

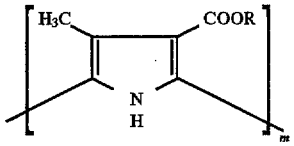

(I)

wherein m represents an integer of 100 to 10,000 and R is methyl or butyl; and

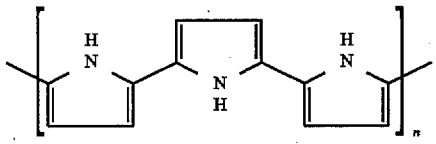

(II)

wherein n represents an integer of 33 to 334.

The polypyrrole polymers represented by formula (I) may include a copolymer of a pyrrole derivative in which R is ethyl and a pyrrole derivative in which R is butyl.

Examples of specific electron acceptors to be used in the present invention include tetracyanotetraazanaphthalene and tetracyanoethylene. Among these, tetracyanotetraazanaphthalene, particularly, 2,3,6,7-tetracyano-1,4,5,8-tetraazanaphthalene is preferable terms of solvent resistance.

Represented by the following formula (III) is 2,3,6,7-tetracyano-1,4,5,8-tetraazanaphthalene:

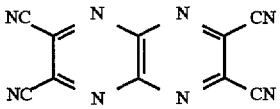

(III)

To ensure a satisfactory electrical conductivity, the weight ratio (solid weight ratio) of the electrically conductive organic polymer and the electron acceptor is preferably within a range between 1:1 and 8:1, more preferably 4:1.

The content (on the basis of solid weight, hereinafter the same) of the charge-transfer complex in the back layer is preferably within a range between 35% and 75% by weight, more preferably within a range between 45% and 60% by weight. If the content is less than the aforesaid range, the surface resistivity of the back layer may be increased. On the other hand, if the content is greater than the aforesaid range, the stick-preventive performance of the back layer is deteriorated so that dust from the back layer may adhere to a thermal head.

Examples of specific resin binders to be used for the back layer include various heat-resistant resins such as silicone resins, silicone-modified urethane resins, silicone-modified acrylic resins, fluorine-containing resins, nitrocellulose resins and melamine resins. Among these, the silicone-modified urethane resins and silicone-modified acrylic resins are particularly preferable because the heat resistance and friction resistance thereof and the affinity thereof to the charge-transfer complex are generally excellent in a well-balanced manner.

The back layer of the thermal transfer sheet preferably contains a curing agent.

Examples of specific curing agents include polyisocyanates such as tolylenediisocyanate (TDI), 1,6-hexamethylenediisocyanate (HDI), isophoronediioscyanate (IPDI), xylenediisocyanate (XDI), 1-methyl-2,4-cyclohexanediisocyanate (H6XDI). Among these, TDI is particularly preferable in terms of a balance between the reactivity thereof and the pot-life of a coating liquid containing the same for the back layer.

The content of the curing agent in the back layer can be suitably adjusted depending on the type and content of the binder resin to be used and the type of the curing agent, but may be within a range between 1% and 50% by weight with respect to the binder resin, preferably within a range between 5% and 40% by weight.

The back layer may further contain a lubricating agent such as a phosphoric ester, silicone oil or zinc stearate, or particles such as melamine resin particles or silicone resin particles, in such an mount that the object of the present invention is not defeated.

For the formation of the back layer, the binder resin, the electrically conductive organic polymer, the electron acceptor and, as required, the curing agent and other additives are dissolved or dispersed in an appropriate solvent to prepare a coating liquid. The coating liquid is applied to one side of the foundation and dried. The coating amount (on the basis of dried amount) is preferably within a range between 0.1 $g/m^2$ and 1.0 $g/m^2$, more preferably within a range between 0.4 $g/m^2$ and 0.6 $g/m^2$. If the coating amount is less than the aforesaid range, the back layer does not impart a sufficient heat resistance to the foundation and the foundation may be prone to stick to the thermal head. On the other hand, if the coating amount is greater than the aforesaid range, the resulting back layer tends to produce dust which may adhere to the thermal head.

Any foundation used for a thermal transfer sheet of this type may be used in the present invention. Examples thereof include polyester films such as polyethylene terephthalate film, polyethylene naphthalate film and polyarylate films, polycarbonate films, polyamide films, aramid films, polyamideimide films, polyimide films, cellophane film and other plastic films, and thin paper sheets of a high density such as glassine paper and condenser paper. The thickness of the foundation is preferably about 1.5 μm to about 10 μm.

The recording agent layer may be any of those conventionally used for a thermal transfer sheet of this type. Exemplary recording agent layers include the following types:

(1) Heat-meltable transfer layer for one-time printing

An exemplary heat-meltable transfer layer is a homogeneous layer of a heat-meltable ink comprising a coloring agent and a heat-meltable vehicle (including a wax and/or a heat-meltable resin) as principal components.

(2) Thermal transfer layer for multiple-time printing

One exemplary thermal transfer layer is a nontransferable porous resin layer (including a porous layer composed of resin or a porous layer comprising porous particles bound with a resin binder) which contains a heat-meltable ink including a coloring agent and a heat-meltable vehicle as principal components. The heat-meltable ink gradually oozes out of the porous resin layer every time that the thermal transfer sheet is heated. Another exemplary thermal transfer layer is an ink layer comprising a coloring agent, a heat-meltable vehicle and a filler as principal components. The heat-meltable ink layer is transferred in increments relative to the thickness direction of the ink layer that every time the thermal transfer sheet is heated.

(3) Thermally migratable dye transfer layer

One exemplary thermally migratable dye layer is a nontransferable resin layer containing a thermally migratable dye such as a sublimation dye which is to be solely transferred on a receptor.

The thermal transfer sheet with a recording agent layer composed of a heat-meltable transfer ink will be explained in more detail.

Useful as the coloring agent are organic or inorganic pigments or dyes which are preferably capable of exhibiting a color density required for a recording material and which are not susceptible to a color change by light, heat, temperature and like factors. Alternatively, substances capable of developing colors when they are heated or brought in contact with a specific agent applied on a receptor may be used. In addition to cyan, magenta, yellow and black coloring agents, coloring agents of various colors may also be used.

The heat-meltable vehicle of the heat-meltable transfer ink may contain a wax as a principal component and, as required, a drying oil, a resin, a mineral oil, cellulose or a rubber derivative. A thermally conductive substance may be added to the recording agent layer comprising the heat-meltable ink to improve the thermal conductivity and melt-transfer performance thereof. Examples of specific thermally conductive substances include carbon materials such as carbon black, aluminum, copper, tin oxide and molybdenum disulfide.

Exemplary methods for forming the recording agent layer composed of the heat-meltable ink on the foundation include hot-melt coating, hot lacquer coating, gravure coating, gravure reverse coating and roll coating, which are known in the art.

The thickness of the recording agent layer composed of the heat-meltable ink may be suitably determined in consideration of a required print density, thermal sensitivity and the like, but is typically about 0.1 μm to about 30 μm.

A surface layer comprising a wax may be formed on the recording agent layer. The surface layer constitutes part of the transfer layer and defines a surface which is to be brought into contact with a receptor. The surface layer serves to fill the uneven surface of the receptor, to prevent staining of the receptor, and to improve the adhesion of the heat-meltable ink to the receptor.

The thermal transfer sheet with a recording agent layer containing a thermally migratable dye will be explained in more-detail.

Useful as dyes for the formation of the recording agent layer are thermally migratable dyes, such as sublimation dyes, which are conventionally known to be used for a thermal transfer sheet. Examples of specific sublimation dyes include MS Red G, Macrolex Red Violet R, Ceres Red 7B, Samaron Red HBSL and Resolin Red F3BS for red color, Foron Brilliant Yellow 6GL, PTY-52 and Macrolex Yellow 6G for yellow color, and Kayaset Blue 714, Waxoline Blue AP-FW, Foron Brilliant Blue S-R and MS Blue 100 for blue color.

Useful as the binder resin for carrying the thermally migratable dye are any of those conventionally known in the art. Examples of specific binder resins include cellulosic resins such as ethyl cellulose, hydroxyethyl cellulose, hydroxypropyl cellulose, methyl cellulose, cellulose acetate, cellulose acetate butyrate and nitrocellulose, vinyl resins such as polyvinyl alcohol, polyvinyl acetate, polyvinyl butyral, polyvinyl acetal, polyvinyl pyrrolidone and polyacrylamide, and polyester resins. Among these binder resins, the cellulosic resins, acetal resins, butyral resins and polyester resins are particularly preferable.

For the formation of the recording agent layer, the thermally migratable dye, the binder resin and other optional additives are dissolved or dispersed in an appropriate solvent to prepare a coating liquid. The coating liquid is applied on the foundation film and dried. The thickness of the recording agent layer is preferably about 0.2 μm to about 0.5 μm. The amount of the sublimation dye contained in the recording agent layer is preferably about 5% to about 90% by weight.

The present invention will be more fully described by way of examples and comparative examples thereof. It is to be understood that the present invention is not limited to these examples, and various changes and modifications may be made in the invention without departing from the spirit and scope thereof.

Examples 1 to 3 and Comparative Examples 1 to 3

Back-layer coating liquids having the compositions shown in Table 1 were each applied on one side of a 4.5 μm-thick polyethylene terephthalate film by means of a bar coater and dried. Thus, back layers each having a dried coating amount of 0.5 g/m$^2$ were formed on the polyethylene terephthalate films.

An ink composition containing the following ingredients was applied on the other side of each of the polyethylene terephthalate films by hot-melt coating to form a heat-meltable ink layer having a coating amount of 4.0 g/m$^2$. Thus, thermal transfer sheets were obtained.

| Ingredient | Parts by weight |
|---|---|
| Paraffin wax | 75 |
| Ethylene-vinyl acetate copolymer | 5 |
| Carbon black | 20 |

The surface resistivity of the back layer of each of the thermal transfer sheets thus obtained was measured. After a printing operation was performed under the following conditions, damage to a thermal head, adhesion of back layer components to the thermal head and sticking of the thermal transfer sheet to the thermal head were checked in the following manner. The results are shown in Table 1.

Printing conditions

Printer: JW95HP RUPO available from Toshiba Co., Ltd.

Printing speed: 100 cps (fast-speed mode)

Total traveling distance of the thermal transfer sheet for printing: 3 Km

Receptor: High-quality paper with a Bekk smoothness of 50 sec (1) Surface resistivity (Ω/cm$^2$)

The surface resistivity was measured by means of a high-resistance resistivity meter (Hiresta IP available from Mitsubishi Petrochemical Co., Ltd.).

(2) Damage to thermal head

A metallographic microscope (HFX-II available from Nikon Corporation) was used to evaluate the damage to the thermal head on the following criteria:

○: No change was observed in comparison with an unused state of the thermal head (Practically acceptable level);

Δ: A slight change was observed in comparison with an unused state of the thermal head, while heating elements could be discriminated from each other; and X: The heating elements were cracked, (3) Adhesion of back layer components to thermal head The metallographic microscope was used to evaluate the adhesion of the back layer components to the thermal head on the following criteria:

○: No change was observed in comparison with an unused state of the thermal head (Practically acceptable level);

Δ: The state of the thermal head was substantially restored to its unused state after the thermal head was cleaned with alcohol; and X: The back layer components adhered to the surface of the thermal head too firmly to be cleaned with alcohol.

(4) Sticking

The sticking (a phenomenon where the back layer of the thermal transfer sheet in contact with the thermal head fuses and sticks onto the thermal head during the printing operation) was evaluated on the following criteria:

○: No sticking was observed (Practically acceptable level); and

Δ: Slight sticking was observed.

TABLE 1

| | Ex. 1 | Ex. 2 | Ex. 3 | Com Ex. 1 | Com. Ex. 2 | Com. Ex. 3 |
|---|---|---|---|---|---|---|
| Back layer coating liquid *1 (Parts by weight) | | | | | | |
| Polypyrrole SS-PY *2 | 28 | 40 | 60 | | | 64 |
| Dopant TCNTAN *3 | 7 | 10 | 15 | | | 16 |
| Silicone-modified urethane resin | 40 | | 20 | 70 | | 15 |
| Silicone-polyvinyl butyral copolymer | | 50 | | | 100 | |
| TDI polyisocyanate | 25 | | 5 | 30 | | 5 |
| Methyl ethyl ketone | 1710 | 1710 | 1710 | 1710 | 1710 | 1710 |
| Toluene | 190 | 190 | 190 | 190 | 190 | 190 |
| Evaluation results | | | | | | |
| Surface resistivity (Ω/cm$^2$) | $10^{10}$ | $10^8$–$10^9$ | $10^6$ | $10^{16}$ or greater | $10^{16}$ or greater | $10^5$ |
| Damage to thermal head | ○ | ○ | ○ | Δ | Δ | ○ |
| Adhesion of back layer components to thermal head | ○ | ○ | ○ | ○ | ○ | Δ |
| Sticking | ○ | ○ | ○ | ○ | ○ | Δ |

*1 Represented by parts by weight of solid content except for solvent

*2 Polypyrrole polymer represented by formula (I) which is a copolymer of a pyrrole derivative wherein R is ethyl and a pyrrole derivative wherein R is butyl (available from Nippon Soda Co., ltd.)

*3 2,3,6,7-tetracyano-1,4,5,8-tetraazanaphthalene (available from Nippon Soda Co., Ltd.)

In accordance with the first feature of the present invention, the thermal transfer sheet has a back layer which contains a binder resin and a charge-transfer complex comprising an electrically conductive organic polymer serving as an electron donor and an electron acceptor. The back layer has a surface resistivity of not greater than $10^{11}$Ω/cm$^2$. Therefore, the thermal transfer sheet is not electrostatically charged when the thermal transfer sheet is rubbed against a thermal head or separated from a receptor. The thermal head will not suffer from electrostatic discharge from the thermal transfer sheet nor from any damage by the electrostatic discharge. Since the back layer does not contain any hard component, damage to the thermal head can be minimized in comparison with the conventional thermal transfer sheet having a back layer containing carbon black.

In accordance with the second feature of the present invention, the thermal transfer sheet has a back layer containing a curing agent and, therefore, the heat resistance of the back layer can be improved. Even if the thermal transfer sheet is stored in a rolled state at a high temperature, the migration of components of the back layer can be reduced.

In accordance with the third feature of the present invention, the thermal transfer sheet has a back layer containing polyisocyanate as the curing agent. Therefore, the heat resistance can be further improved, and the migration of the components of the back layer can be further reduced.

In accordance with the fourth feature of the present invention, the thermal transfer sheet has a back layer containing a polypyrrole polymer as the electrically conductive organic polymer. Therefore, the surface resistivity of the back layer can be properly reduced.

In accordance with the fifth feature of the present invention, the thermal transfer sheet has a back layer containing a polypyrrole polymer represented by formula (I) as the electrically conductive organic polymer. Therefore, the surface resistivity of the back layer can be further reduced.

In accordance with the sixth feature of the present invention, the thermal transfer sheet has a back layer containing 2,3,6,7-tetracyano-1,4,5,8-tetraazanaphthalene as the electron acceptor. Therefore, the surface resistivity of the back layer can be further reduced.

In accordance with the seventh feature of the present invention, the thermal transfer sheet has a back layer which contains the electrically conductive organic polymer and the electron acceptor in a total mount of 35% to 75% by weight. Since the back layer has a sufficiently reduced surface resistivity and a sufficient heat resistance, the thermal head will not suffer from adhesion of dust from the back layer, and the back layer is free from sticking.

In addition to the materials and ingredients used in the Examples, other materials and ingredients can be used in Examples as set forth in the specification to obtain substantially the same results.

What we claim is:

1. A thermal transfer sheet comprising:

a foundation;

a recording agent layer provided on one side of the foundation; and a back layer provided on the other side of the foundation, said back layer comprising a binder resin, an electrically conductive organic polymer and an electron acceptor, said electrically conductive organic polymer serving as an electron donor; and said back layer having a surface resistivity of not greater than $10^{11}\Omega/cm^2$.

2. The thermal transfer sheet of claim 1, wherein the back layer comprises a curing agent.

3. The thermal transfer sheet of claim 2, wherein the curing agent is polyisocyanate.

4. The thermal transfer sheet of claim 1, wherein the electrically conductive organic polymer is a polypyrrole polymer represented by formula (I):

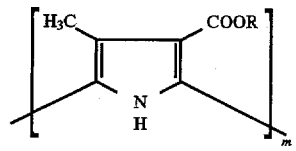

(I)

wherein m represents an integer of 100 to 10,000, and R is ethyl or butyl.

5. The thermal transfer sheet of claim 1, wherein the electron acceptor is 2,3,6,7-tetracyano-1,4,5,8-tetraazanaphthalene.

6. The thermal transfer sheet of claim 1, wherein the electron acceptor and the electrically conductive organic polymer serving as the electron donor comprise a total amount of 35% to 75% by weight of the back layer.

* * * * *

UNITED STATES PATENT AND TRADEMARK OFFICE

CERTIFICATE OF CORRECTION

PATENT NO. : 5,686,184

DATED : November 11, 1997

INVENTOR(S) : Yoshimoto Akamatu, et. al.

It is certified that error appears in the above-identified patent and that said Letters Patent is hereby corrected as shown below:

Column 1, line 40 delete "mount" and substitute therefor -- amount --.

Column 1, line 47 delete "mount" and substitute therefor -- amount --.

Column 3, line 38 delete "2,3,6,7-tetracyanol, 1,4,5,8-" and substitute therefor -- 2,3,6,7-tetracyano-1,4,5,8- --.

Column 4, line 32 after "preferable" insert -- in --.

Column 5, line 35 after "foundation" insert -- conventionally --.

Column 5, line 66 delete "that."

Column 5, line 67 after "time" insert -- that --.

Column 9, line 24 delete "mount" and substitute therefor -- amount --.

Signed and Sealed this

Twenty-sixth Day of December, 2000

*Attest:*

Q. TODD DICKINSON

*Attesting Officer*

*Director of Patents and Trademarks*